United States Patent [19]

Mizushima et al.

[11] 4,363,996

[45] Dec. 14, 1982

[54] VIDICON TYPE CAMERA TUBE

[75] Inventors: Masashi Mizushima, Shizuoka; Masanori Maruyama, Kokubunji; Shigeru Ehata, Mobara; Masakazu Fukushima, Kokubunji, all of Japan

[73] Assignee: Hitachi, Ltd., Tokyo, Japan

[21] Appl. No.: 215,335

[22] Filed: Dec. 11, 1980

[30] Foreign Application Priority Data

Dec. 19, 1979 [JP] Japan ..... 54-164058

[51] Int. Cl.[3] ..... H01J 29/46; H01J 29/56; H01J 31/38

[52] U.S. Cl. ..... 313/449; 313/389

[58] Field of Search ..... 313/389, 390, 449

[56] References Cited

U.S. PATENT DOCUMENTS 3,866,079 2/1975 Schut ..... 313/389

3,928,784 12/1975 Weijland ..... 313/389

4,268,777 5/1981 Roosmalen ..... 313/389 X

FOREIGN PATENT DOCUMENTS 55-121254 9/1980 Japan ..... 313/449

*Primary Examiner*—Robert Segal

*Attorney, Agent, or Firm*—Antonelli, Terry & Wands

[57] ABSTRACT

A vidicon type camera tube comprising a beam current control section including a thermionic cathode, a first grid having an aperture of diameter $d_1$, a second grid having an aperture of diameter $d_2$ and a beam disc having a diaphragm of diameter $d_3$ disposed at a distance of l along the tube axis from the second grid. The tube further comprises a main lens section constituted of cylindrical electrodes. The diameters $d_1$, $d_2$ and $d_3$ and the distance l are so determined that the value of $(d_2/l)(d_3/d_1)^2$ may lie in the range where the difference of the effective cathode loading is positive.

1 Claim, 6 Drawing Figures

VIDICON TYPE CAMERA TUBE

This invention relates to a vidicon type camera tube and more particularly to the structure of the beam current control section (or triode section) of such a camera tube.

As well known, in a vidicon type camera tube, electric charges induced on the photoconductive layer in accordance with the brightness of an object are discharged by the use of an electron beam scanning and the charging current flowing then into the capacitance of the photoconductive layer is detected as a video signal current. Unless the electron beam used for scanning carries sufficient current, a video signal current with respect to the charges distributed on the photoconductive layer cannot be obtained with high fidelity and therefore the reproduced picture image will suffer from the so called "beam shortage condition" that degrades picture image quality very much. In order to prevent the "beam shortage condition", the current carried by the scanning beam is ordinarily set to be several times the video signal current derived upon imaging an object having a standard brightness. Especially in the open air where an object will have a high contrast, the current carried by the scanning electron beam must be set sufficiently large.

The general drawback of the conventional vidicon type camera tube is that the increase in the beam-carried current must accompany the increase in the diameter of the beam and therefore that the resolution of the imaged object is considerably degraded.

Namely, it is difficult for the conventional vidicon type camera tube to take a picture image of an object having a high brightness without degrading the resolution.

It is therefore one object of this invention to provide a vidicon type camera tube in which the increase in the beam current causes only a small degradation in the resolution.

This invention, which has been made to attain the above object, is featured by making minimum the divergence of the electron beam due to the initial-velocity spread of thermionic emission.

Other objects, features and advantages of this invention will be apparent from the following description made on the basis of the present inventors' simulation, taken in conjunction with the accompanying drawings, in which.

Figure 1:
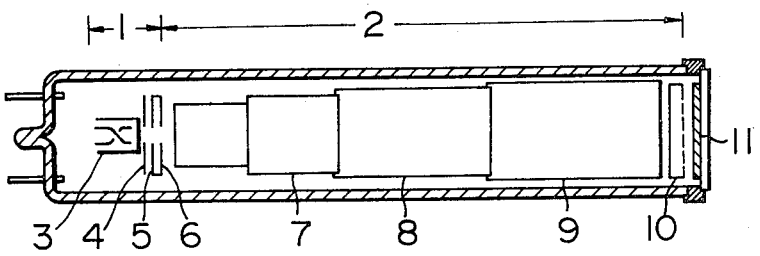
FIG. 1 shows in longitudinal section a structure of a vidicon type camera tube.

FIG. 1 shows in longitudinal section a structure of a vidicon type camera tube, which comprises a beam current control section (or triode section) 1 and a main lens section 2. The beam current control section 1 comprises a thermionic cathode 3, a first grid 4, a second grid 5 and a beam disc 6. The quantity of current carried by the electron beam emitted by the thermionic cathode 3 is controlled by the first grid 4. The second grid 5 accelerates the electron beam. The beam is made narrow by means of a small diaphragm (hereinafter sometimes referred to as aperture) provided in the beam disc 6 and the narrowed beam is sent into the main lens section 2. The main lens section 2 comprises a third grid 7, a fourth grid 8 and a fifth grid 9, each in the form of a cylindrical electrode, and a sixth grid 10 in the form of a mesh electrode. The three cylindrical electrodes 7, 8 and 9 constitute an electrostatic focusing lens which focuses the electron beam from the beam current control section 1 upon the surface of a photoconductive layer 11. Moreover, the fifth and sixth grids 9 and 10 form a collimation lens which serves to cast the electron beam always perpendicularly to the photoconductive layer 11.

With such a vidicon type camera tube, the resolution is related closely to the diameter of the electron beam on the photoconductive layer and the smaller is the diameter, the higher is the resolution. The lower limit of the diameter of the beam, however, depends on the aberration of the main lens section and the initial-velocity spread of thermionic emission. Accordingly, the limitation by the aberration of the main lens section will be first described. The electron beam, when entering the main lens section 2 from the beam current control section 1, is constricted by the diaphragm of the beam disc 6 and concentrated along the tube axis. As a result, it suffices to regard the third order spherical aberration as the aberration of the main lens section and the spread of the beam diameter at the focal point due to the third order spherical aberration, i.e. the diameter $D_c$ of the circle of least confusion, is expressed as:

$$D_c = \tfrac{1}{2} M_L C_S \theta_o^3 = D_{co} \theta_o^3, \tag{1}$$

where $M_L$ is the magnifying power of the main lens section, $C_S$ the third order spherical aberration coefficient, $\theta_o$ the divergence angle of incident beam at the entrance of the main lens section, and $D_{co}$ the diameter of the circle of least confusion for $\theta_o = 1°$.

The initial-velocity spread of thermionic emission will now be described. The increase in the diameter $D_L$ of the electron beam due to the initial-velocity spread of thermionic emission, provided that the current density $\rho_s$ is assumed to be of rectangular distribution in the Langmuir's formula which associates the effective current density $\rho_{ceq}$ at the thermionic cathode 3 (defined as an effective cathode loading or a value $\rho_{ceq}$ to which $\rho_c$ at the thermionic cathode is reduced through the cutting of a part of the Gaussian beamlet by the disk or circle) with the current density $\rho_s$ at the focal point, is given by the following expression:

$$D_L = 2\left(\frac{k}{\pi e}\right)^{\frac{1}{2}} \cdot \left(\frac{T}{V}\right)^{\frac{1}{2}} \cdot \left(\frac{i_B}{\rho_{ceq}}\right)^{\frac{1}{2}} \cdot \frac{1}{M_A \theta_o}, \tag{2}$$

where k is the Boltzmann constant, e the charge of electron, T the temperature of the thermionic cathode, V the potential at the focal point, $i_B$ the current quantity carried by the electron beam entering the main lens section at the diaphragm of the beam disc, and $M_A$ the angular magnification of the main lens section.

The diameter of the electron beam is largely affected by, besides the above-described factors, i.e. the aberration in the main lens section and the initial-velocity spread of thermionic emission, the higher order aberration and the space charge effect in the main lens section. However, the latter two factors are negligible since the beam is sufficiently narrow and concentrated along the tube axis and since the current density of the beam is low. As a result, the diameter D of the electron beam is expressed as follows.

$$D=(D_c^2+D_L^2)^{\frac{1}{2}} \quad (3)$$

In the expressions (1) and (2), both the incident divergence angle $\theta_o$ and the effective cathode loading $\rho_{ceq}$ are functions of the beam current $i_B$. Since the incident divergence angle $\theta_o$ increases with the increase in the beam current $i_B$, the diameter $D_c$ of the circle of least confusion will also increase, as apparent from the expression (1).

However, the present inventors' comparison has revealed that the enlargement $D_L$ of the beam diameter due to the initial-velocity spread of thermionic emission is at least twice as large as the diameter $D_c$ of the circle of least confusion and that the former has greater influence upon the beam diameter D than the latter. In order to prevent the increase in the beam diameter due to the increase in the beam current $i_B$, therefore, it is effective to prevent the increase in the enlargement $D_L$ of the beam diameter due to the initial-velocity of thermionic emission, arising from the increase in the beam current $i_B$. From this point of view, the relationship between the effective cathode loading $\rho_{ceq}$ and the beam current $i_B$ proves important in the expression (2). Namely, it is apparent that the enlargement $D_L$ of the beam diameter is suppressed by decreasing the change in the ratio $i_B/\rho_{ceq}$ of the beam current $i_B$ to the effective cathode loading $\rho_{ceq}$.

Figure 2:
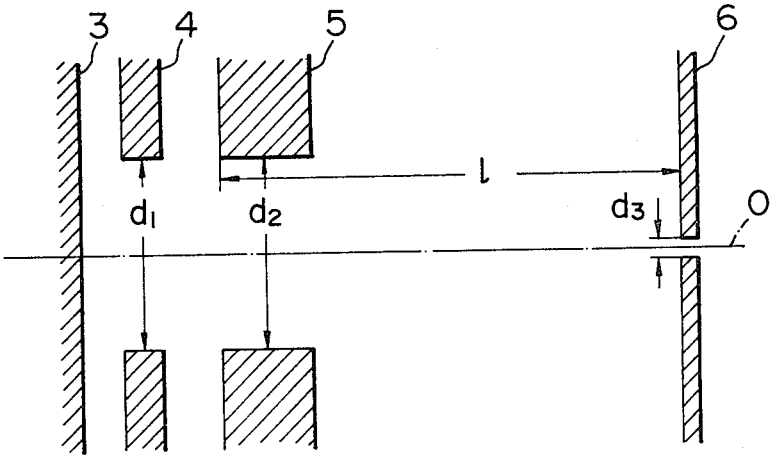
FIG. 2 shows in longitudinal section the beam current control section of the camera tube shown in FIG. 1.

Now, the operation of the beam current control section will be described with the aid of FIG. 2. FIG. 2 shows in longitudinal section the beam current control section of the camera tube shown in FIG. 1. In FIG. 2, O indicates a tube axis; $d_1$, $d_2$ and $d_3$ the diameters of the apertures cut respectively in the first grid 4, the second grid 5 and the beam disc 6; and l the distance along the tube axis from the cathode-side surface of the second grid 5 to the cathode-side surface of the beam disc 6. The Gaussian beamlet emitted from a point on the thermionic cathode 3 tends to diverge, but it is gradually focused to form a cathode image by a lens action established by the first and second grids 4 and 5. The beam disc 6 controls the beam current $i_B$, depending on its positional relation to the cathode image, by setting the incident angle of the beam entering the main lens section in a suitable range of values or by letting only a part of the electron beam emitted from the thermionic cathode 3 pass through the diaphragm of the beam disc 6. The same voltage is applied to the second grid and the beam disc 6. It is therefore easily understood that the beam current $i_B$ and the effective cathode loading $\rho_{ceq}$ equal to the effective current density of the electrons contained in the beam current $i_B$ on the thermionic cathode are strongly affected by the electrode structure of the beam current section, e.g. the relative positions and the aperture diameters of the electrodes 4, 5 and 6.

With the above consideration in mind, the present inventors have obtained, through computer simulation verification with experiment, the relationship between the electrode structure of the beam current control section and the change in the effective cathode loading $\rho_{ceq}$ with the increase in the beam current $i_B$, and derived a concrete electrode structure for the beam current control section from the results of the computer simulations.

Figure 3:
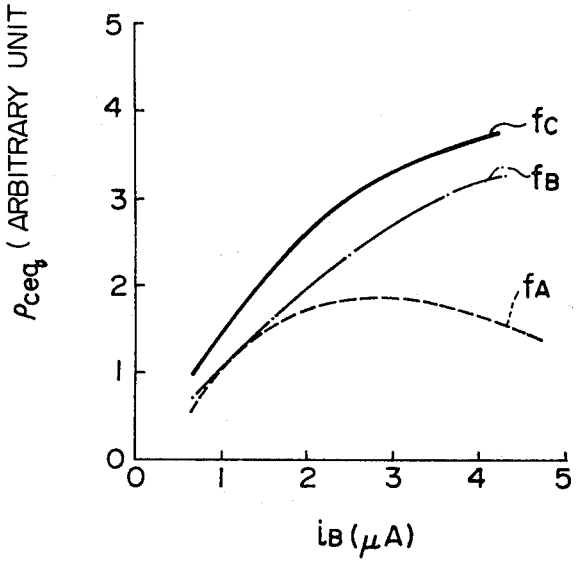
FIG. 3 shows the relationship between the beam current $i_B$ and the effective cathode loading $\rho_{ceq}$.

The simulations were effected through using as boundary conditions the shapes and the dimensions of the electrodes constituting the beam current control section and the voltages applied to the electrodes, calculating the distribution of potential within the beam current control section under the consideration of space charge effect due to the electron beam, and obtaining the trajectories of electrons by substituting the calculated potential distribution into an equation of electron motion. The electrons emanating from a point on the surface of the thermionic cathode are distributed, as a result of thermal motion, in a mode of the Gaussian function in the radial direction (Gaussian beam). The effective cathode loading $\rho_{ceq}$ is therefore calculated from the ratio of the number of the electrons passing through the diaphragm of the beam disc to the number of the whole electrons distributed (i.e. the distribution width of the Gaussian beam). The beam current $i_B$ can be obtained by integrating the current density at the diaphragm of the beam disc over the entire surface of the small aperture. For example, the curve $f_A$ (dashed curve) in FIG. 3 was plotted for the relationship between the beam current $i_B$ and the effective cathode loading $\rho_{ceq}$ in a conventional beam current control section having the following dimensions and electrode voltage with respect to the thermionic cathode: the diameter $d_1$ of the aperture of the first grid 4 is 0.65 mm, the diameter $d_2$ of the aperture of the second grid 5 is 0.65 mm, the diameter $d_3$ of the diaphragm of the beam disc 6 is 0.05 mm, and the distance l from the second grid to the beam disc is 1.6 mm; and the voltage $V_{G1}$ at the first grid is $0\sim-100$ V, the voltage $V_{G2}$ at the second grid is 300 V. The beam current $i_B$ is partially absorbed by electrodes between the first grid 4 and the photoconductive layer 11 or turned back by a reverse electric field. Accordingly, only about a quarter of the beam current $i_B$ generated by the thermionic cathode is received by the photoconductive layer 11. With a vidicon type camera tube of 18 mm diameter, a signal current of 0.2 μA flows for a standard brightness. In this case, the beam current $i_B$ must be at least 0.8 μA. For imaging in the open air where the brightness of the object varies over a rather wide range, the beam current $i_B$ is always set to be at least three times that value (i.e. $i_B \geqq 2.4$ μA). However, as seen from the curve $f_A$ in FIG. 3, in the conventional beam current control section, the effective cathode loading $\rho_{ceq}$ becomes maximum for beam current of $2.5\sim3.0$ μA and gradually decreases for greater beam current $i_B$. Therefore, the ratio $i_B/\rho_{ceq}$ becomes very great for beam current $i_B$ in excess of 3.0 μA so that the enlargement $D_L$ of the diameter of the electron beam due to the initial-velocity spread of thermionic emission is considerably enhanced. This is the cause of the remarkable degradation of resolution due to the increase in the beam current in the conventional vidicon type camera tube. Curves $f_B$ (short-and-long dash curve) and $f_C$ (solid curve) in FIG. 3 represent the relations between the beam current $i_B$ and the effective cathode loading $\rho_{ceq}$, in camera tube embodying this invention and the detailed explanation of these curves will be given later.

Figure 4:
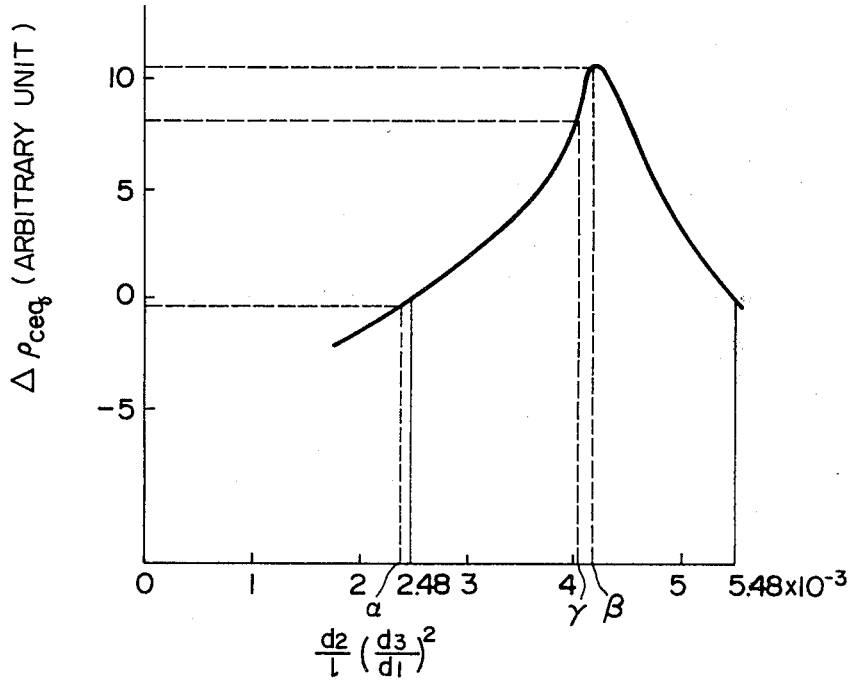
FIG. 4 shows the variation of the effective cathode loading $\rho_{ceq}$.

Then, a quantity $(d_2/l)(d_3/d_1)^2$ is introduced as a parameter for restricting the electrode structure for a beam current control section while the difference $\Delta\rho_{ceq}$ between the effective cathode loadings $\rho_{ceq}$ for beam currents $i_B$ of 3.2 μA and 2.4 μA is considered as the variation of the effective cathode loading $\rho_{ceq}$ with respect to the increase in the beam current $i_B$. FIG. 4 shows the relationship between $(d_2/l)(d_3/d_1)^2$ and $\Delta\rho_{ceq}$, obtained from the result of computer simulation. As apparent from FIG. 4, $(d_2/l)(d_3/d_1)^2$ is about $2.40\times10^{-3}$ (represented by α in FIG. 4) and the corresponding $\Delta\rho_{ceq}$ is approximately zero for a conventional example. Namely, the increase in the effective cathode loading $\rho_{ceq}$ with the increase in the beam current $i_B$ is in the saturated condition and therefore the increase in the beam current $i_B$ no longer causes the increase in the effective cathode loading $\rho_{ceq}$ so that the increase in the beam current $i_B$ causes a considerable increase in the ratio $i_B/\rho_{ceq}$. Hence, according to this invention, the range of $(d_2/l)(d_3/d_1)^2$ for which $\Delta\rho_{ceq}$ is positive, that is, the range such that:

$$2.48\times10^{-3} < \frac{d_2}{l}\left(\frac{d_3}{d_1}\right)^2 < 5.48\times10^{-3} \quad (4)$$

is selected upon reference to FIG. 4 and the increase in the enlargement $D_L$ of the beam diameter is suppressed by suppressing the increase in $i_B/\rho_{ceq}$ due to the increase in the beam current $i_B$. Namely, if the electrode structure of a beam current control section is so designed that the parameter $(d_2/l)(d_3/d_1)^2$ may satisfy the inequality (4), then the effective cathode loading $\rho_{ceq}$ continues to increase near a value 3.2 μA of $i_B$. Therefore, the effective cathode loading $\rho_{ceq}$ increases with the increase in the beam current in the practical operating range (0.8 μA$\leqq i_B \leqq$3.2 μA) of the beam current $i_B$, whereby the increase in $i_B/\rho_{ceq}$ due to the increase in $i_B$ can be suppressed. As apparent from the expression (2), the enlargement of the beam diameter $D_L$ can also be suppressed so that the enlargement of the beam diameter D can be suppressed as apparent from the expression (3). As a result, a camera tube in which the degradation of the resolution with the increase in the beam current is very small, can be obtained.

The dimensions of the electrode structure of a beam current control section as embodiments of this invention are as follows:

EMBODIMENT 1

$d_1$=0.5 mm;
$d_2$=0.5 mm;
$d_3$=0.05 mm;
l=1.2 mm.

EMBODIMENT 2

$d_1$=0.5 mm;
$d_2$=0.65 mm;
$d_3$=0.05 mm;
l=1.6 mm.

Here, the voltages applied to the respective electrodes are the same as in the conventional example described before. In the embodiment 1, the beam disc 6 is nearer by 0.4 mm to the thermionic cathode 3 and the diameters $d_1$ and $d_2$ of the apertures of the first and second grids 4 and 5 are smaller by 0.15 mm, than in the conventional example. The value of the parameter $(d_2/l)(d_3/d_1)^2$ in this embodiment is $4.17\times10^{-3}$ (represented by β in FIG. 4), satisfying the expression (4). The embodiment 2 has the diameter $d_1$ of the aperture of the first grid 4 reduced by 0.15 mm and the parameter $(d_2/l)(d_3/d_1)^2$ assumes a value of $4.06\times10^{-3}$ (represented by γ in FIG. 4), satisfying the expression (4). The relationships between beam current $i_B$ and effective cathode loading $\rho_{ceq}$, obtained for the embodiments 1 and 2 are represented respectively by the curves $f_B$ and $f_C$ in FIG. 3. As apparent from FIG. 3, the range of the beam current $i_B$ for which the effective cathode loading $\rho_{ceq}$ continues to increase, is broadened and the values for $\rho_{ceq}$ itself are very much increased. For example, in the embodiment 2 corresponding to the curve $f_C$, the value of the effective cathode loading $\rho_{ceq}$ is as large as 1.7 times at $i_B$=2.4 μA and 1.8 times at $i_B$=3.2 μA that of $\rho_{ceq}$ in the conventional example (represented by the curve $f_A$). Accordingly, within the practical operating range of the beam current $i_B$, the effective cathode loading $\rho_{ceq}$ increases with the increase in the beam current $i_B$ and also the effective cathode loading $\rho_{ceq}$ itself becomes greater. Therefore, the increase in $i_B/\rho_{ceq}$ due to the increase in $i_B$ is suppressed to a considerable extent so that the beam diameter $D_L$ given by the expression (2) is rendered to a very small value.

Figure 5:
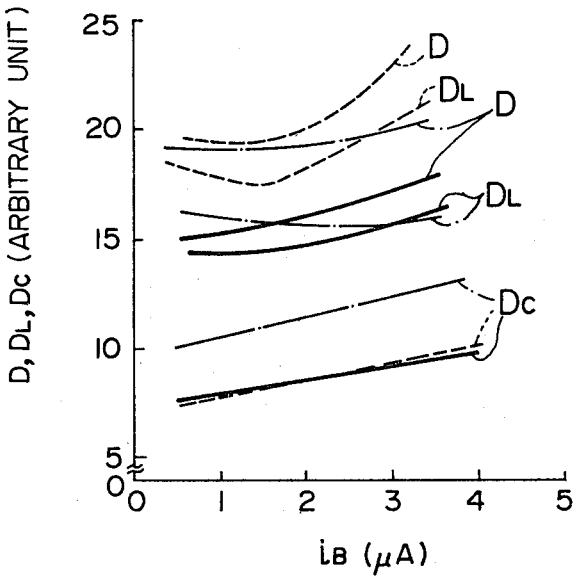
FIG. 5 shows the relationship of the beam current $i_B$ to the beam diameters $D_C$, $D_L$ and D.
Figure 6:
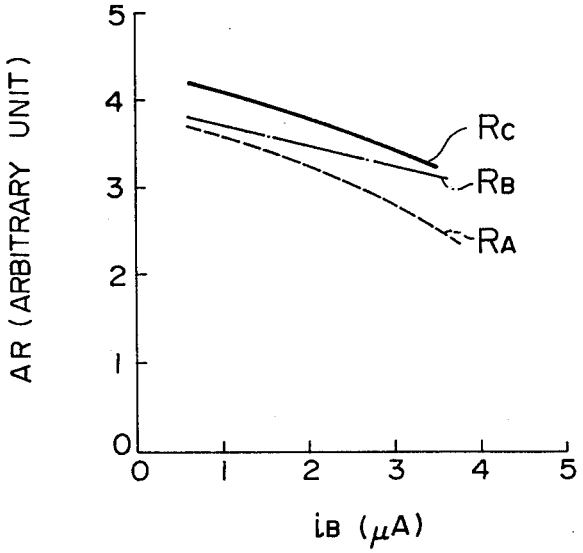
FIG. 6 shows the relationship between the beam current $i_B$ and the solution AR.

FIG. 5 shows the relationships of the beam current $i_B$ to the beam diameters $D_2$, $D_L$ and D given by the above expressions (1), (2) and (3). In FIG. 5, broken curves corresponds to conventional examples, long-and-short-dash curves to the above embodiment 1, and solid curves to the above embodiment 2. As apparent from FIG. 5, the enlargements of the beam diameters $D_L$ in the embodiments 1 and 2 are much smaller than that in the conventional example. For example, in the comparison of the embodiment 1 with the conventional example, the difference is more conspicuous in the region where the beam current is large. Namely, the absolute value of the beam diameter $D_L$ is small and moreover the beam diameter $D_L$ in the embodiment 1 continues to decrease until the beam current $i_B$ reaches about 2.5 μA and the rate of the increase in $D_L$ for $i_B$ in excess of 2.5 μA is also small whereas the beam diameter $D_L$ in the conventional example assumes its minimum value for a beam current of about 1.5 μA and begins to increase for greater beam current. On the other hand, the beam diameter $D_C$ gradually increases with the increase in the beam current $i_B$ and since the value of the beam diameter $D_C$ is approximately less than a half of the value of the beam diameter $D_L$, the increase in $D_C$ has little relation to the remarkable increase in the beam diameter D. Therefore, the enlargements of the beam diameters D in the embodiments 1 and 2 are suppressed to a considerable extent in the practical operating range and this is a remarkable improvement over that in the conventional example. This is also apparent from the result of the actual measurement of resolution AR (Amplitude Response for 400 TV lines) shown in FIG. 6. FIG. 6 shows the relationships between beam currents $i_B$ and the resolutions AR actually measured with the above-described conventional camera tube and the camera tubes as the above embodiments 1 and 2, curves $R_A$, $R_B$ and $R_C$ corresponding respectively to the conventional example, the embodiments 1 and 2. Since the reciprocal of the beam diameter D corresponds approximately to the resolution AR, the dependency of the actually measured resolutions upon the beam current $i_B$, shown in FIG. 6 coincides satisfactorily with the calculated beam diameter D shown in FIG. 5. This verifies the usefulness of this invention. For example, when the beam current $i_B$ is changed from 0.8 μA to 3.2 μA, the actually measured resolutions AR in the embodiments 1 and 2 of this invention are respectively lowered by only 14.7% and 19.3% while the actually measured resolution AR of the conventional example, represented by the curve $R_A$, falls by as large as 26.0%. Moreover, the value of the actually measured resolution itself is greater in the embodiments 1 and 2 than in the conventional example. This also proves the advantage of this invention over the conventional example.

As described above, according to this invention, there can be provided a camera tube which has a high resolution and in which the degradation of resolution due to the increase in the current carried by the scanning electron beam is very small and with this camera tube, an object having a high brightness can be imaged with high resolution.

What we claim is:

1. A vidicon type camera tube comprising a beam current control section including a thermionic cathode, a first grid having an aperture of diameter $d_1$, a second grid having an aperture of diameter $d_2$ and a beam disc having a diaphragm of diameter $d_3$ disposed at a distance of l along the tube axis from said second grid, and further comprising a main lens section, wherein said diameters $d_1$, $d_2$ and $d_3$ and said distance l are selected to satisfy the relation of $2.48\times10^{-3}<(d_2/l)(d_3/d_1)^2<5.48\times10^{-3}$.

* * * * *